United States Patent [19]

White

[11] 4,423,530

[45] Jan. 3, 1984

[54] SHOE UPPER HEAT SETTING MACHINE

[75] Inventor: Anthony M. White, Oadby, England

[73] Assignee: USM Corporation, Farmington, Conn.

[21] Appl. No.: 338,233

[22] Filed: Jan. 11, 1982

[51] Int. Cl.[3] ..... A43D 21/00

[52] U.S. Cl. ..... 12/1 A

[58] Field of Search ..... 12/1 A, 1 R, 1 W

[56] References Cited

U.S. PATENT DOCUMENTS

| | | | |
|---|---|---|---|
| 3,533,117 | 10/1970 | Dinolfo et al. | 12/1 A |
| 3,760,445 | 9/1973 | Stapleton et al. | 12/1 A |
| 4,369,536 | 1/1983 | Hanson et al. | 12/1 A |

*Primary Examiner*—Patrick D. Lawson

*Attorney, Agent, or Firm*—Donald N. Halgren

[57] ABSTRACT

The heat setting machine comprises a channel along which a lasted shoe upper is conveyed to be subjected to heat. The apparatus comprises a resiliently deformable member extending along and secured to one side of the channel. The resiliently deformable member, which may be in the form of an inflated bag, is arranged to extend across the channel to engage a cooperating member secured to the other side of the channel and thereby close the top of the channel. By deformation of the resiliently deformable member, the leg portion of the lasted upper of high-legged boot can be inserted between the members to be supported thereby as it is conveyed along the channel.

9 Claims, 3 Drawing Figures

SHOE UPPER HEAT SETTING MACHINE

FIELD OF THE INVENTION

This invention is concerned with a machine for use in heat setting a lasted shoe upper. The term shoe when used herein is to be understood as referring to outer footwear generally whether complete or in the course of manufacture and including, in particular, boots.

Prior Art

Heat setting is an operation performed in the manufacture of shoes to hasten shape retention of a lasted shoe upper so that the time which the shoe has to remain on the last can be reduced. In many heat setting apparatuses, the lasted shoe upper is conveyed through a chamber containing hot moist air which heat sets the upper. In such apparatuses, a problem is encountered in heat setting high-legged boots in that, if the leg of the boot is laid flat to pass through the chamber, the chamber must be made undesirably wide and the apparatus operates inefficiently in terms of energy consumption. Inefficient operation, also results from making the chamber sufficiently high for the leg to pass through it in a vertical condition. The inefficiency results from the extra energy required to supply hot moist air to the larger chamber. If, on the other hand, the leg is folded before entering the chamber, it may become creased and heat setting of the remainder of the upper may also be impaired.

One proposal, for dealing with the problem of passing the uppers of high-legged boots through the chamber of a heat setting apparatus, is to construct the chamber in the form of a channel having a lid which comprises two longitudinally-extending portions which are movable relative to one another transversely of the channel to provide a longitudinally-extending slot. The edges of the slot support the leg as the upper passes along the channel with much of the leg outside the channel. This proposal, while allowing an improvement on previous apparatuses, has the disadvantages that an operator of the apparatus has to frequently adjust the width of the slot to accommodate differing boots, and the slot allows a considerable amount of hot moist air to escape from the apparatus decreasing the efficiency of the apparatus and possibly causing discomfort to an operator thereof.

It is an object of the present invention to provide an apparatus for use in heat setting a lasted shoe upper in which apparatus the above-mentioned disadvantages of the above-mentioned proposal are overcome.

BRIEF SUMMARY OF THE INVENTION

The invention provides apparatus for use in heat setting a lasted shoe upper comprising a framework forming an elongated substantially enclosed channel, conveying means operable to convey lasted shoe uppers along the channel, heating means operable to supply heat to the channel to heat a lasted shoe upper being conveyed along the channel to cause heat setting of the lasted shoe upper, and a resiliently deformable member secured to the framework at one side of the channel and extending along the channel, the resiliently deformable member being arranged to extend across the channel to engage a cooperating member secured to the framework at the other side of the channel and to thereby close the top of the channel. The arrangement is such that, by deformation of the resiliently deformable member, the leg portion of the lasted upper of a high-legged boot can be inserted between the resiliently deformable member and the cooperating member to be supported by these members as the upper is conveyed along the channel.

While the cooperating member of an apparatus according to the last preceding paragraph may be an unresilient member such as a metal plate, it is preferred that it is also a resiliently deformable member. The or each resiliently deformable member may be in the form of an inflated bag; which is advantageous since it provides good insulation and is not so susceptable to fatigue as many resiliently deformable members. Advantageously, when the resiliently deformable member is an inflated bag, the apparatus comprises air blowing means operable, when the apparatus is in use, to continuously blow air into the or each inflated bag; this enables fabric bags to be used, prevents minor leaks in the bags from rendering them inoperative, and cools the bags allowing them to more readily withstand the temperatures to which they are subjected.

BRIEF DESCRIPTION OF THE DRAWINGS

There now follows a detailed description, to be read with reference to the accompanying drawings, of an apparatus for use in heat setting a lasted shoe upper which is illustrative of the invention. The illustrative apparatus has been selected for description by way of example and not of limitation of the invention.

In the drawings.

DESCRIPTION OF THE PREFERRED EMBODIMENT

Figure 1:
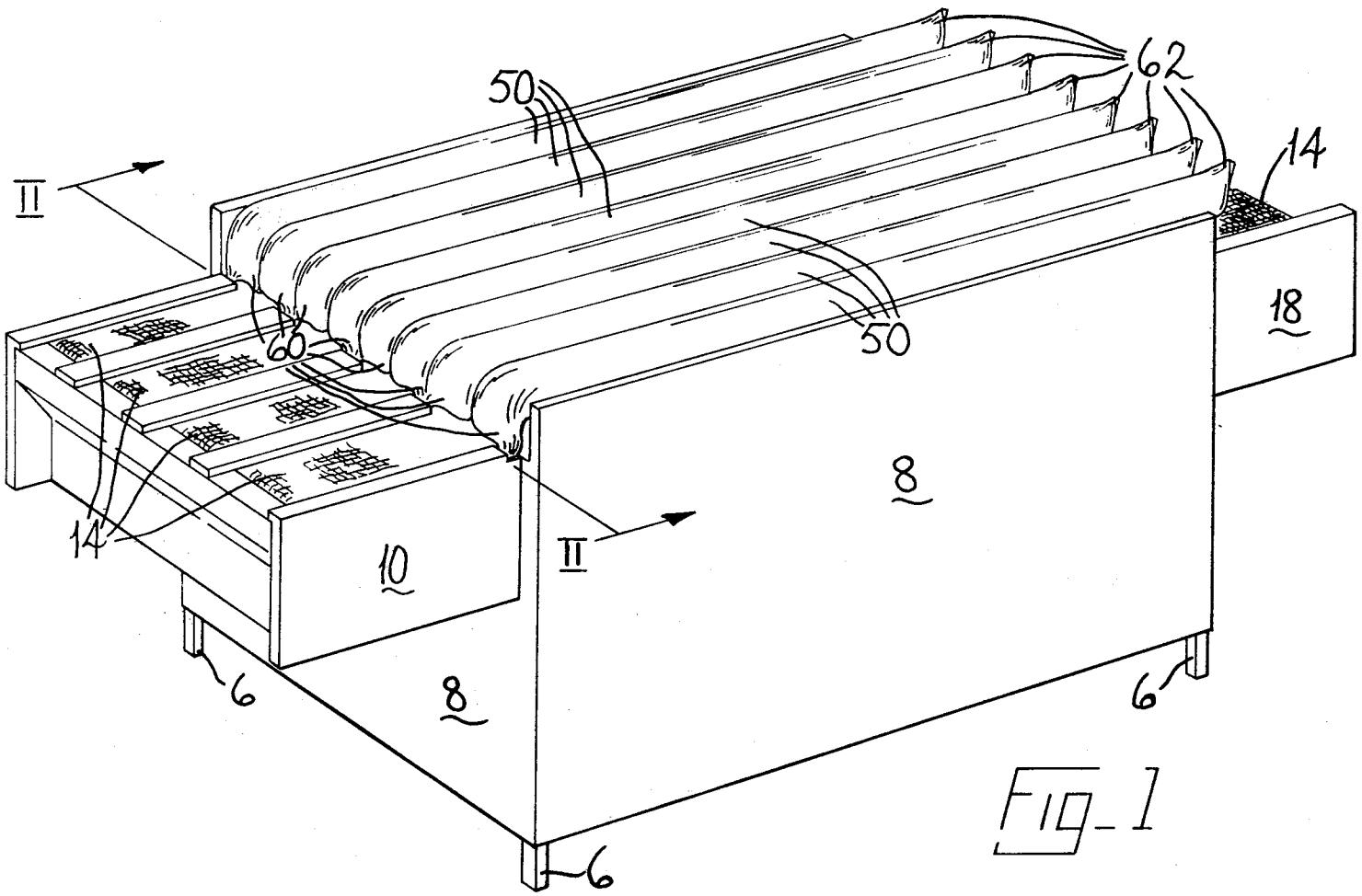
FIG. 1 is a perspective view of the illustrative apparatus.

The illustrative machine, shown in FIG. 1 is for use in heat setting a lasted shoe upper and comprises a supporting framework supported by four legs 6 and enclosed by sheet metal panels 8. At a front portion of the apparatus, the framework has a forward extension 10 which supports a roller, not shown around which an arrangement of four conveyor belts 14 pass. The conveyor belts 14 are made of mesh material so that they are permeable to air and extend longitudinally of the apparatus to a second roller, not shown, supported by a rearward extension 18 of the framework. The extension 18 also supports a motor, not shown, operable to drive the conveyor belts 14 so that a lasted shoe upper placed on one of the belts 14 above the extension 10 will be carried to the extension 18.

Figure 2:
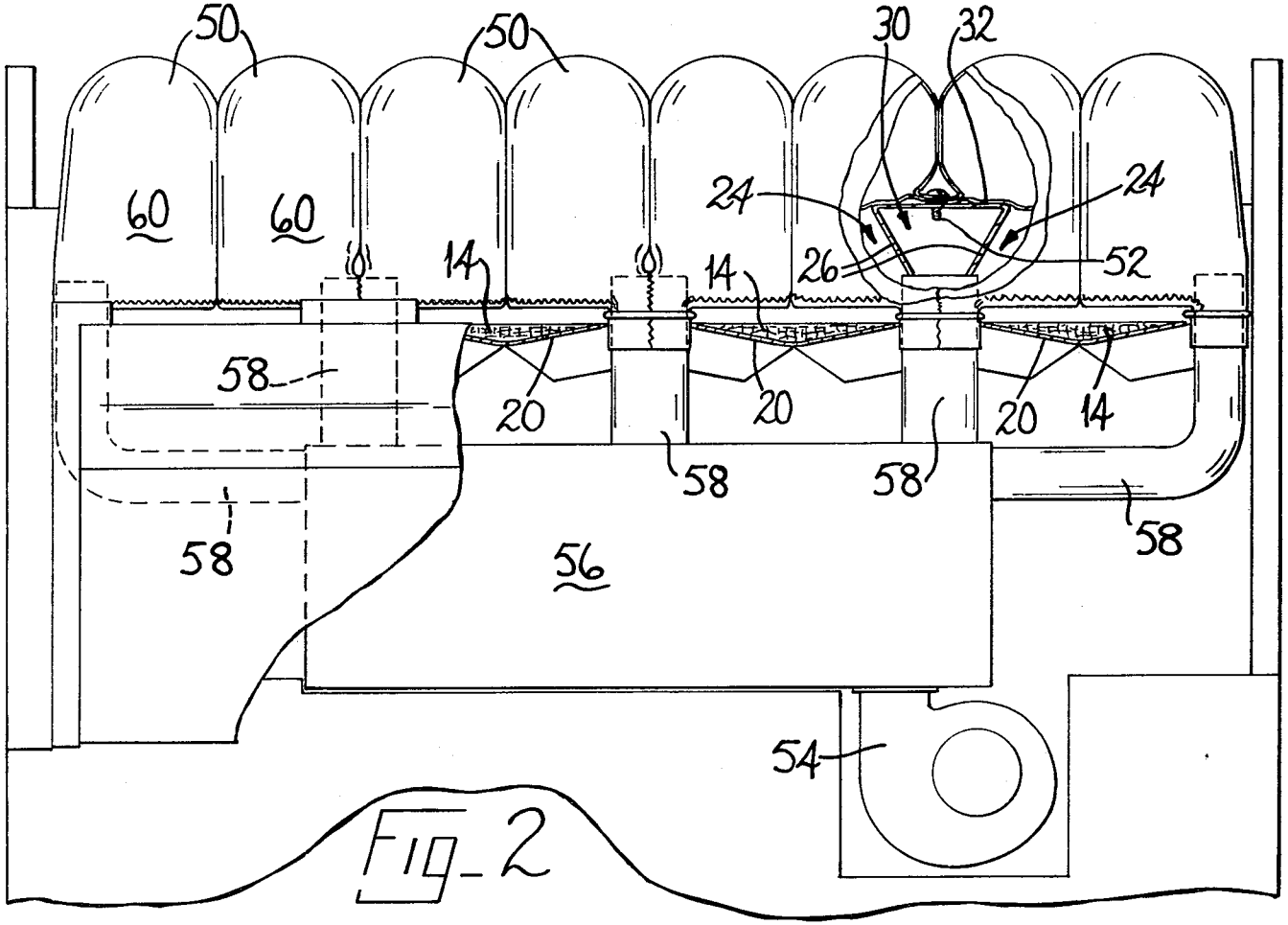
FIG. 2 is a cross-sectional view, on a larger scale than FIG. 1, taken on the line II—II in FIG. 1.

Each of the belts 14 extends along the upper surface of a plate 20 as shown in FIG. 2, supported by the framework, there being one plate 20 to each belt 14. Each plate 20 is bowed downwards towards its center as shown in FIG. 2, and the belts 14 are thus also bowed downwards; this bowing assists in maintaining a lasted shoe upper on a belt 14 in an upright condition. The plates 20 are perforated so that air can pass through them.

Between the extensions 10 and 18, the belts 14 each pass through a framework forming an elongated substantially enclosed channel 24, each belt 14 acting as conveying means operable to convey lasted shoe uppers along its channel 24. The illustrative apparatus, thus, comprises a plurality, viz four, channels 24. The channels 24 are formed between eight longitudinally-extending plates 26 of the framework as shown in FIG. 2. Each plate 26 is inclined towards the center of its associated channel and contains holes, not shown, at intervals along the channel 24 through which hot moist air can be blown into the channel 24. Six of the plates 26 (those which lie between channels) act in pairs to form three air passages 30 between the channels 24 and the remaining plates 26 act with vertical plates, not shown, supported at the edges of the apparatus by the framework, to form two further air passages 30. Each of the five air passages 30 is provided with a plate 32 of the framework which acts as a lid therefor.

The air passages 30 communicate at their bottoms with a chamber, not shown, into which a fan, not shown, associated with a heater, also not shown, and a moisture supply, not shown, is arranged to blow hot moist air. The hot air passes into the passages 30 and then into the channels 24 through the holes in the plates 26. The fan and its associated heater, therefore, provide heating means operable to supply heat to the channel 24 to heat a lasted shoe upper being conveyed along the channel 24 to cause heat setting of the lasted upper. The hot air leaves the channel 24 by passing through the belt 14 and the plate 20 before being returned to the fan.

The channels 24 each have two resiliently deformable members, in the form of inflated bags 50, associated therewith. The bags 50 may be made of nylon fabric which on the side thereof which forms the interior of the bag 50 may be coated with polyurethane to render the bag more air-tight. Each bag 50 extends along the channel 24 and is secured to the framework at one side of the channel 24. Each bag 50 is secured to one of the plates 32 by screws 52 which pass through a seam portion of the bag 50, i.e. a portion of the material from which the bag 50 is made which is on the opposite side of the seam which closes the bag from the bag itself. The bags 50 are arranged to extend across the channel 24 to engage a cooperating member, which is also a resiliently deformable member viz. another of the bags 50, secured to the other side of the channel 24 and to thereby close the top of the channel 24 preventing hot air from escaping from the top of the channel 24.

The arrangement of the bags 50 is such that, by deformation of one or both of the bags of a particular channel, the leg portion of the lasted upper of a high-legged boot can be inserted between the bags 50 to be supported by these bags as the upper is conveyed along the channel by the belt 14.

In order to maintain the bags 50 in an inflated condition, the illustrative apparatus comprises air blowing means, in the form of a fan 54, operable, when the apparatus is in use, to continuously blow air into the bags 50 of every channel 24. The fan 54 blows air at ambient temperature into a chamber 56 from which pipes 58 lead to the interior of each bag 50.

Figure 3:
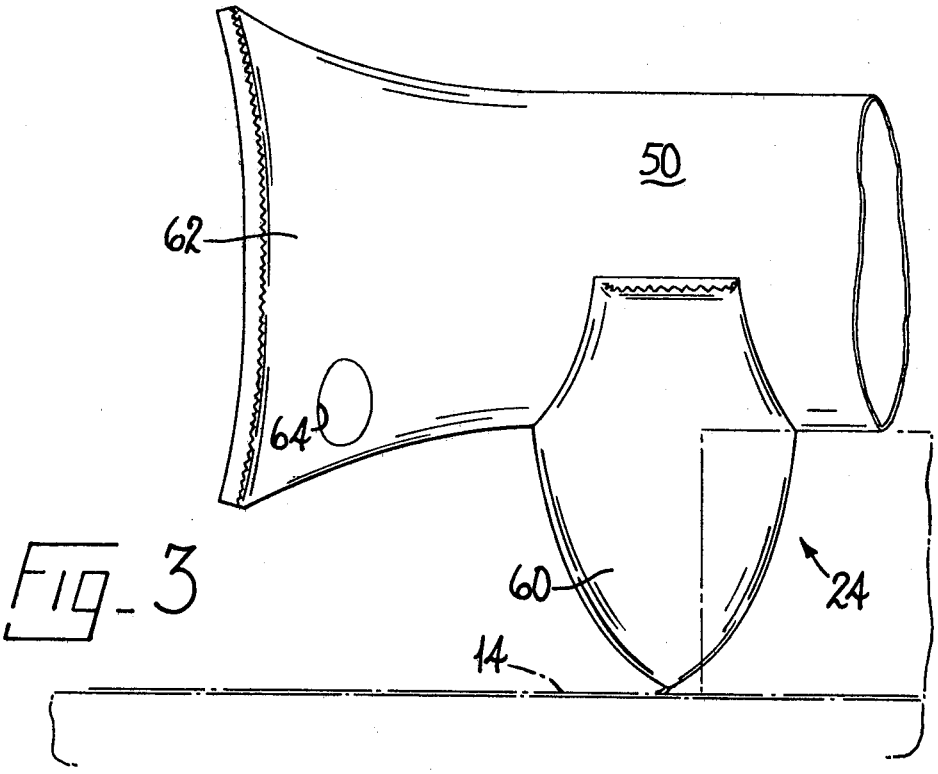
FIG. 3 is a side elevational view, on a larger scale than FIGS. 1 and 2, of one end portion of an inflated bag of the illustrative apparatus.

Each bag 50 is constructed with a depending portion 60 at each end of the channel 24 with which it is associated, as shown in FIG. 3. Each depending portion 60 serves to partially close the end of the channel 24 but is deformable to allow entry to or exit from the channel 24 by lasted shoe uppers being conveyed by the belts 14.

At the extension 18 end thereof, each bag 50 has a portion 62 which projects beyond the depending portion 60 and has an exit port 64, as shown in FIG. 3, therein so positioned that air leaving the bag 50 through the port 64 blows on to lasted shoe uppers leaving the channel 24 having a cooling effect on them.

The illustrative apparatus does not require adjustment to accommodate differing boots and loses very little hot air through the top of the channels 24.

Having thus described my invention and what I claim as new and desire to secure as Letters Patents of the United States is:

1. A machine for use in heat setting a lasted shoe upper comprising:

a framework forming an elongated substantially enclosed channel;

conveying means operable to convey lasted shoe uppers along the channel;

heating means operable to supply heat to the channel to heat a lasted shoe upper being conveyed along the channel to cause heat setting of the lasted shoe upper; and a resiliently deformable member secured to the framework at one side of the channel and extending along the channel, the resiliently deformable member being arranged to extend across the channel to engage a cooperating member secured to the framework at the other side of the channel and to thereby close the top of the channel, the arrangement being such that, by deformation of the resiliently deformable member, the leg portion of the lasted upper of a high-legged boot can be inserted between the resiliently deformable member and the cooperating member to be supported by these members as the upper is conveyed along the channel.

2. A machine as recited in claim 1 wherein said cooperating member is also a resiliently deformable member.

3. A machine as recited in claim 2 wherein the or each resiliently deformable member is an inflated bag.

4. A machine as recited in claim 3 wherein an air blowing means is arranged to continuously blow air into the or each inflated bag.

5. A machine as recited in claim 4 including:

a plurality of channels, each having at least one inflated bag associated therewith, said air blowing means being operable to blow air into the bags of every channel.

6. A machine as recited in claim 5 wherein said air blowing means is operable to blow air at ambient temperature into each inflated bag.

7. A machine as recited in claim 6 wherein each inflated bag is made of a nylon fabric which on the side thereof which forms the interior of the bag is coated with polyurethane.

8. A machine as recited in claim 6 wherein each inflated bag has an exit port therein so positioned that air leaving each inflated bag through the port blows on to any lasted shoe uppers leaving said channels.

9. A machine as recited in claim 8 wherein each resiliently deformable member has a depending portion at each end of said channels which serves to close the end of each channel but is deformable to allow entry to or exit from the channels by any lasted shoe uppers being conveyed by the conveying means.

* * * * *